US009557103B2

(12) United States Patent
Mak

(10) Patent No.: US 9,557,103 B2
(45) Date of Patent: Jan. 31, 2017

(54) ETHANE RECOVERY AND ETHANE REJECTION METHODS AND CONFIGURATIONS

(75) Inventor: John Mak, Santa Ana, CA (US)

(73) Assignee: Fluor Technologies Corporation, Sugar Land, TX (US)

( * ) Notice: Subject to any disclaimer, the term of this patent is extended or adjusted under 35 U.S.C. 154(b) by 615 days.

(21) Appl. No.: 13/996,805

(22) PCT Filed: Dec. 15, 2011

(86) PCT No.: PCT/US2011/065140

§ 371 (c)(1),
(2), (4) Date: Sep. 17, 2013

(87) PCT Pub. No.: WO2012/087740

PCT Pub. Date: Jun. 28, 2012

(65) Prior Publication Data

US 2014/0007616 A1 Jan. 9, 2014

Related U.S. Application Data

(60) Provisional application No. 61/426,756, filed on Dec. 23, 2010, provisional application No. 61/434,887, filed on Jan. 21, 2011.

(51) Int. Cl.
*F25J 3/00* (2006.01)
*F25J 3/02* (2006.01)

(52) U.S. Cl.
CPC ..... *F25J 3/0238* (2013.01); *F25J 3/0209* (2013.01); *F25J 3/0228* (2013.01); *F25J 3/0233* (2013.01); *F25J 3/0242* (2013.01); *F25J 3/0247* (2013.01); *F25J 2200/02* (2013.01);

(Continued)

(58) Field of Classification Search
CPC ..... F25J 3/0209; F25J 3/0233; F25J 3/0238; F25J 3/0242; F25J 2200/04; F25J 2200/70; F25J 2200/74; F25J 2200/76; F25J 2200/78; F25J 2210/06; F25J 2215/60; F25J 2215/62; F25J 2215/64; F25J 2240/02; F25J 2240/04; F25J 2280/02
See application file for complete search history.

(56) References Cited

U.S. PATENT DOCUMENTS 4,854,955 A 8/1989 Campbell
5,771,712 A 6/1998 Campbell (Continued)

FOREIGN PATENT DOCUMENTS

WO 99/23428 5/1999
WO 9923428 5/1999

(Continued)

OTHER PUBLICATIONS

PCT/US2011/065140 filed Dec. 15, 2011 entitled Ethane Recovery and Ethane Rejection Methods and Configurations, PCT Search Report & Written Opinion dated Apr. 18, 2012.

*Primary Examiner* — Keith Raymond
(74) *Attorney, Agent, or Firm* — Conley Rose, P.C.; Kristin Jordan Harkins

(57) ABSTRACT

Contemplated plants for flexible ethane recovery and rejection by allowing to switch the top reflux to the demethanizer from residue gas to the deethanizer overhead product and by controlling the flow ratio of feed gas to two different feed gas exchangers. Moreover, the pressure of the demethanizer is adjusted relative to the deethanizer pressure for control of the ethane recovery and rejection.

4 Claims, 2 Drawing Sheets

(52) U.S. Cl.
CPC ..... *F25J 2200/04* (2013.01); *F25J 2200/70* (2013.01); *F25J 2200/72* (2013.01); *F25J 2200/74* (2013.01); *F25J 2200/76* (2013.01); *F25J 2200/78* (2013.01); *F25J 2205/04* (2013.01); *F25J 2210/06* (2013.01); *F25J 2215/60* (2013.01); *F25J 2215/62* (2013.01); *F25J 2215/64* (2013.01); *F25J 2230/30* (2013.01); *F25J 2235/60* (2013.01); *F25J 2240/02* (2013.01); *F25J 2240/04* (2013.01); *F25J 2245/02* (2013.01); *F25J 2280/02* (2013.01)

(56) References Cited

U.S. PATENT DOCUMENTS

| | | | | |
|---|---|---|---|---|
| 5,953,935 | A | 9/1999 | Sorensen | |
| 6,116,050 | A * | 9/2000 | Yao | F25J 3/0209 62/630 |
| 6,125,653 | A | 10/2000 | Shu et al. | |
| 6,363,744 | B2 | 4/2002 | Finn | |
| 6,453,698 | B2 | 9/2002 | Jain | |
| 6,516,631 | B1 | 2/2003 | Trebble | |
| 6,837,070 | B2 | 1/2005 | Mak | |
| 7,051,553 | B2 | 5/2006 | Mak | |
| 7,856,848 | B2 | 12/2010 | Lu | |
| 2004/0159122 | A1 * | 8/2004 | Patel | F25J 3/0209 62/620 |
| 2010/0011809 | A1 | 1/2010 | Mak | |
| 2010/0206003 | A1 | 8/2010 | Mak | |

FOREIGN PATENT DOCUMENTS

| | | | | |
|---|---|---|---|---|
| WO | 2004/017002 | | 2/2004 | |
| WO | 2004017002 | | 2/2004 | |
| WO | 2005/045338 | | 5/2005 | |
| WO | 2005045338 | | 5/2005 | |
| WO | 2008/002592 | | 1/2008 | |
| WO | 2008002592 | | 1/2008 | |
| WO | WO 2008002592 | A2 * | 1/2008 | F25J 3/0209 |
| WO | WO 2009023252 | A1 * | 2/2009 | F25J 3/0209 |

* cited by examiner

ETHANE RECOVERY AND ETHANE REJECTION METHODS AND CONFIGURATIONS

This application claims priority to our copending U.S. provisional applications having Ser. Nos. 61/426,756 (filed Dec. 23, 2010) and 61/434,887 (filed Jan. 21, 2011).

FIELD OF THE INVENTION

The field of the invention is gas processing, and especially as it relates to high pressure natural gas processing for ethane recovery and ethane rejection operation.

BACKGROUND OF THE INVENTION

Expansion processes have been widely used for hydrocarbon liquids recovery in the gas processing industry for ethane and propane recovery. External refrigeration is normally required in such processes where the feed gas contains significant quantities of propane and heavier components. For example, in a typical turbo-expander plant, the feed gas is cooled and partially condensed by heat exchange with process streams and/or external propane refrigeration. The condensed liquid containing the less volatile components is then separated and fed to a fractionation column which is operated at a lower pressure than the feed gas pressure. The remaining vapor portion is letdown in pressure in a turbo-expander, resulting in further cooling and liquid formation. With the expander discharge pressure typically at demethanizer pressure, the two-phase stream is fed to the demethanizer with the cold liquids acting as the top reflux to absorb the heavier hydrocarbons. The remaining vapor combines with the column overhead as a residue gas, which is then heated and recompressed to pipeline pressure.

However, in many expander plant configurations, the residue vapor from the demethanizer still contains a significant amount of ethane or propane plus hydrocarbons that could be recovered if chilled to a lower temperature, or subjected to a rectification stage. While lower temperature can be achieved with a higher expansion ratio across the turbo-expander, various disadvantages arise. Among other things, higher expansion typically results in lower column pressure and higher residue gas compression horsepower requirements, making high recovery uneconomical. Lower demethanizer pressure is known to be more prone to $CO_2$ freezing problems which limit the ethane recovery level. Therefore, many NGL recovery configurations employ an additional rectification column, and use of a colder and leaner reflux stream to the fractionation column overhead vapor (see below). Furthermore, most known NGL recovery configurations are optimized for a single mode of operation (i.e., ethane recovery or propane recovery). Thus, when such NGL plants are required to switch recovery mode (e.g., from ethane recovery to propane recovery or ethane rejection), the energy efficiency and propane recovery levels tend to significantly drop. Still further, substantial reconfiguration and operation conditions are necessary in most plants to achieve acceptable results. For example, most of the known ethane recovery plants recover more than 98% of propane and heavier hydrocarbons during the ethane recovery, but often fail to maintain the same high propane recovery during ethane rejection. In ethane rejection operation, the propane recovery levels from such processes often drop to about 90% or lower, thereby incurring significant loss in product revenue.

Present NGL recovery systems can be classified into single-column configurations or two-column configurations, and some operating differences are summarized below. A typical single-column configuration for ethane recovery is described in U.S. Pat. No. 4,854,955. Such configuration may be employed for moderate levels of ethane recovery (typically 75%). In such plants, the column overhead vapor is cooled and condensed by an overhead exchanger using refrigeration content of the column overhead. This additional cooling step condenses the ethane and heavier components from the column overhead gas, which is recovered in a downstream separator and returned to the column as reflux. For ethane rejection, this column operates as a deethanizer, and the column pressure is typically about 350 psig to allow for generation of sufficient refrigeration from turbo-expansion and for ethane/propane separation. However, the lower column pressure generally results in an increased residue gas compression horsepower demand. Other NGL recovery configurations that employ a single column for both ethane recovery and ethane rejection are described in U.S. Pat. No. 6,453,698. Here, an intermediate vapor stream is withdrawn from the column that is cooled in order to generate a reflux to the mid section of column. While the heat integration, reflux configuration, and process complexity vary among many of these designs, all or almost all fails to operate on ethane recovery and ethane rejection mode and require high energy consumption.

Alternatively, a typical two-column NGL plant employs a reflux absorber and a second column that is operated as a demethanizer or deethanizer, which generally allows more flexibility in operating the absorber and the second column at different pressures. However, conventional two-column plants are generally only economic for either ethane recovery or propane recovery, but not both, and switching recovery modes will often incur significant propane losses, typically at less than 90%. In all operations, propane product is a valuable commodity and high recovery at 99% level is desirable.

For example, in U.S. Pat. Nos. 5,953,935 and 5,771,712, the overhead vapor or liquid from the demethanizer is recycled to the upstream absorber as a lean reflux. While such plants provide relatively high ethane and propane recoveries during ethane recovery, ethane rejection with high propane recovery is not achievable without extensive re-configurations. Alternatively, as shown in U.S. Pat. No. 6,363,744, a portion of the residue gas stream from the residue gas compressor discharge is recycled as a lean reflux in the demethanizer However, using residue gas to generate a cold reflux for the demethanizer is necessary for high ethane recovery (over 90%) but not energy efficient when used for propane recovery or ethane rejection. In other words, the use of the residue gas recycle for chilling is an over-kill for propane recovery. Moreover, almost all of the above configurations require cryogenic operating temperatures for both the absorber and the distillation columns and require excessive energy during ethane rejection when only propane product is required. In another example, high ethane recovery without CO2 freezing problems is described in U.S. Pat. App. No. 2010/0011809. However, such systems typically do not allow for operational flexibility.

In improved configurations and methods, as for example disclosed in U.S. Pat. No. 7,051,553 and WO 2005/045338, flexibility of operation is provided by use of two reflux streams and by changing process temperature and the feed point of one of the two reflux streams into the absorber. While such plant configurations provide at least some operational flexibility, various drawbacks (e.g., relatively complex configuration) nevertheless remain. The above noted patents and patent applications, as well as all other extrinsic materials discussed herein are incorporated by reference in their entirety. Where a definition or use of a term in an incorporated reference is inconsistent or contrary to the definition of that term provided herein, the definition of that term provided herein applies and the definition of that term in the reference does not apply.

Thus, numerous attempts have been made to improve the efficiency and economy of processes for separating and recovering ethane and heavier natural gas liquids from natural gas. However, all or almost all of them fail to achieve economic operation when ethane rejection is required. Moreover, currently known configurations fail to provide flexibility in operation where recovery of ethane is only temporarily desired. Therefore, there is still a need to provide improved methods and configurations for flexible natural gas liquids recovery.

SUMMARY OF THE INVENTION

The inventive subject matter is directed to various plant configurations and methods of ethane recovery and rejection at high propane recovery (typically 99% and more typically 99.9%). Most typically, contemplated plants and methods allow for changing the top reflux stream for the absorber such that the top reflux is either provided by the residue gas or by the deethanizer overhead, and further allow for changing the ratio of a feed gas split between two feed gas exchangers. It should further be appreciated that the demethanizer is operated during ethane recovery at a higher pressure than the deethanizer, and at a lower pressure than the deethanizer during ethane rejection or propane recovery operation. Contemplated plants and methods will typically achieve ethane recovery of at least 95% (and more typically at least 98%) during ethane recovery.

In one aspect of the inventive subject matter, a method of flexibly recovering ethane from a feed gas includes a step of feeding into a demethanizer a top reflux and a second reflux below the top reflux, wherein the demethanizer produces a demethanizer bottom product and a demethanizer overhead product. At least part of the demethanizer bottom product is then fed into a deethanizer to so produce a deethanizer bottom product and a deethanizer overhead product, and a portion of the compressed demethanizer overhead product is fed back to the demethanizer as the top reflux during ethane recovery, while a portion of the deethanizer overhead product is fed back to the demethanizer as the top reflux during ethane rejection. Most typically, the demethanizer is operated at a higher pressure than the deethanizer during ethane recovery and at a lower pressure during ethane rejection.

It is further generally preferred that the feed gas is expanded to a lower pressure in a turbo expander to produce a partially expanded feed gas that is then cooled. A portion of the so partially expanded feed is further expanded (typically via JT valve) to produce the second reflux. Likewise, it is generally preferred that a second portion of the partially expanded feed gas is further cooled to produce a partially condensed feed stream, which is then separated into a vapor stream and a liquid stream. The vapor and liquid streams are then further expanded (typically via JT valve) prior to feeding into the demethanizer Most typically, a demethanizer side reboiler cools a third portion of the partially expanded feed gas to so produce a cooled feed stream that may or may not be combined with the chilled or partially condensed feed stream.

In still further preferred aspects of such methods, the flow of the third portion of the partially expanded feed gas to the demethanizer side reboiler is decreased relative to flow of the first and second portions of the partially expanded feed gas during ethane rejection. Thus, it should be appreciated that propane recovery of at least 99% is achieved during ethane recovery and during ethane rejection, and that ethane recovery of at least 95% is achieved during ethane recovery.

Consequently, and viewed from a different perspective, a method of changing ethane recovery to ethane rejection operation in an NGL plant will include a step of changing the top reflux of a demethanizer from a demethanizer overhead product to a deethanizer overhead product for ethane rejection, and reducing the demethanizer pressure to a pressure that is lower than the deethanizer pressure for ethane rejection. As noted before, it is preferred that the demethanizer receives a second reflux below the top reflux, wherein the second reflux is a portion of a feed gas, and wherein the portion of the feed gas is subcooled by the demethanizer overhead product.

Thus, it is also contemplated that the demethanizer produces a bottom product that is fed to a deethanizer to so produce the deethanizer overhead product. Most preferably, the feed gas is cooled before the step of sub-cooling by expanding the feed gas in a turbo expander, and/or the demethanizer is reboiled using heat from the feed gas. Consequently, it is also contemplated that one portion of the feed gas is cooled in a feed gas heat exchanger, while another portion of the feed gas is cooled in a demethanizer reboiler heat exchanger. In such methods, it is especially preferred that during ethane rejection, the flow of the one portion of the feed gas is increased relative to the flow of the another portion of the feed gas. Most preferably, the demethanizer pressure is between 445 psig and 475 psig or higher, and the deethanizer pressure is between 319 psig and 450 psig.

In further preferred aspects of the inventive subject matter, the inventor also contemplates a method of changing ethane recovery to ethane rejection operation in an NGL plant that includes a step of providing a demethanizer that receives a top reflux and a second reflux below the top reflux, wherein the demethanizer is fluidly coupled to a deethanizer In another step, one portion of the feed gas is cooled in a feed gas heat exchanger using a demethanizer overhead product to so produce the second reflux, while another portion of the feed gas is cooled in a demethanizer side reboiler heat exchanger to so produce a demethanizer feed stream. In a still further step, the top reflux of the demethanizer is switched from the demethanizer overhead product to the deethanizer overhead product for ethane rejection, and the flow of the one portion is increased relative to flow of the another portion for ethane rejection.

In especially preferred aspects of such methods, the operating pressure in the demethanizer is reduced to a pressure that is lower than the operating pressure in the deethanizer pressure for ethane rejection. Most typically, the demethanizer bottom product is fed to the deethanizer, and the operating pressure in the demethanizer is between 445 psig and 475 psig or higher, while the operating pressure in the deethanizer is between 319 psig and 450 psig. It is further generally contemplated that the feed gas has a pressure of at least 1000 psig, and more preferably at least 1400 psig, and that the feed gas is expanded in a turbo expander prior to the step of cooling the one and the another portion. Where desirable, the deethanizer bottom product is fed into a depropanizer Various objects, features, aspects and advantages of the inventive subject matter will become more apparent from the following detailed description of preferred embodiments, along with the accompanying drawing figures in which like numerals represent like components.

DETAILED DESCRIPTION

Figure 1:
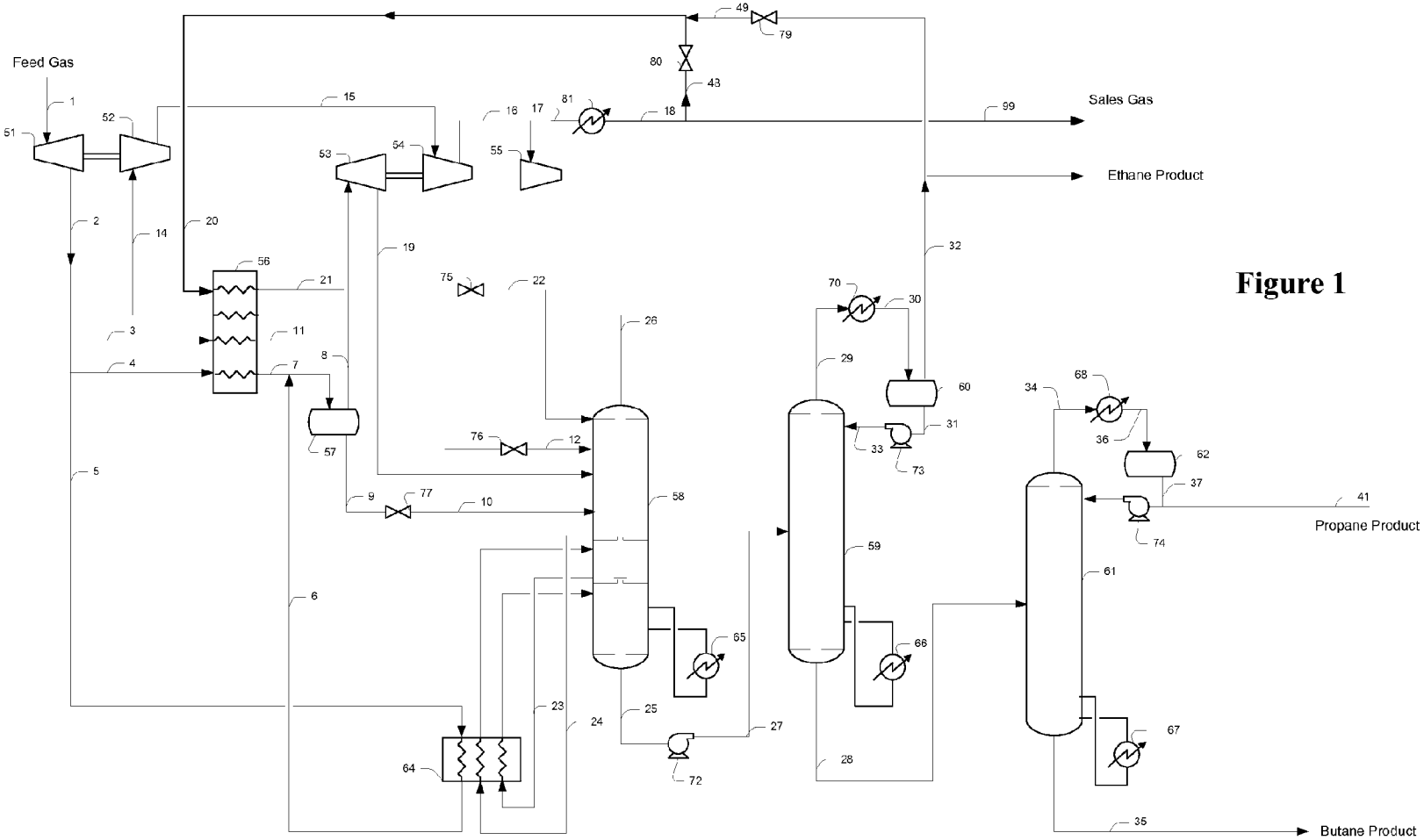
FIG. 1 is a schematic of an exemplary plant configuration according to the inventive subject matter.
Figure 2:
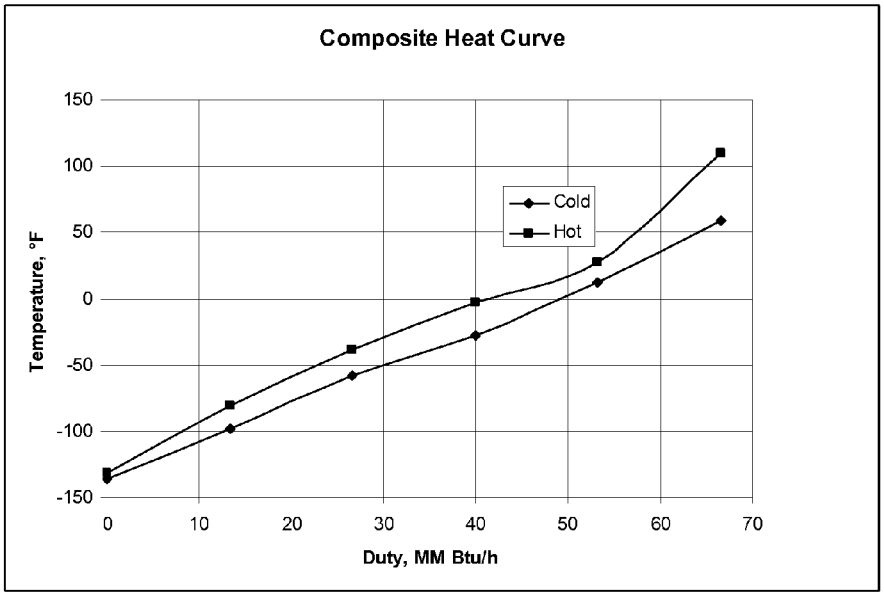
FIG. 2 is a composite heat curve during ethane recovery according to the inventive subject matter.
Figure 3:
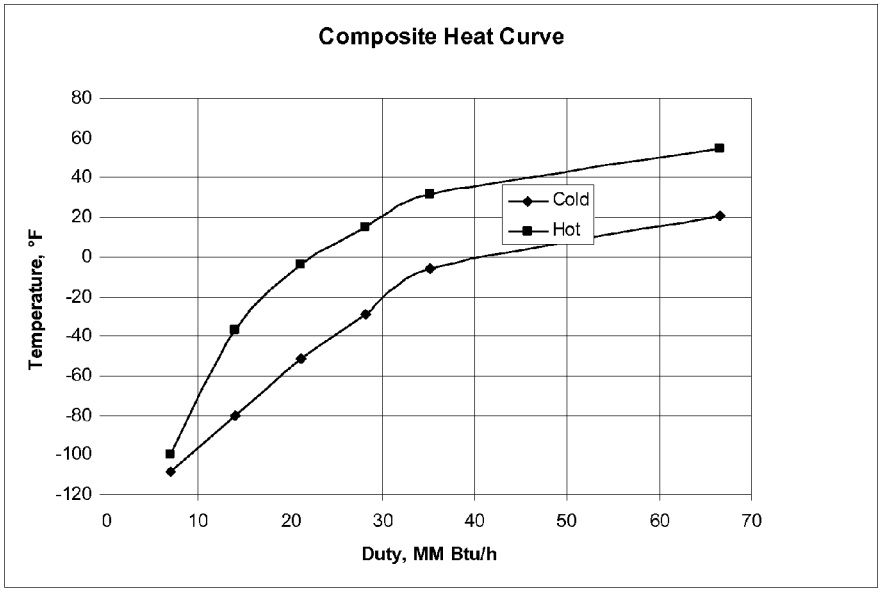
FIG. 3 is a composite heat curve during ethane rejection according to the inventive subject matter.

The inventors have discovered that high propane recovery of 99.9% can be achieved for the ethane recovery and ethane rejection operation by changing the origin of the reflux from residue gas to deethanizer overhead, and by varying the feed gas split ratios to two feed exchangers. In contemplated methods and configurations, the demethanizer is operated at a higher pressure than the deethanizer pressure during ethane recovery, and at a lower pressure than the deethanizer pressure during ethane rejection or propane recovery.

Thus, it should be recognized that during ethane recovery residue gas compression horsepower is reduced as the demethanizer operates at a higher pressure than the deethanizer On the other hand, during ethane rejection it should be noted that the deethanizer overhead can be directed to the demethanizer for refluxing without further compression as the demethanizer pressure is lowered to below that of the deethanizer Consequently, using contemplated configurations and methods, ethane recovery of at least 95%, more typically at least 98% during ethane recovery is achieved.

In one preferred aspect of the inventive subject matter, contemplated plants include a demethanizer and a deethanizer, wherein the demethanizer is configured to receive a top reflux (relative to other streams) that is provided by a residue gas recycle stream during ethane recovery. When ethane rejection is desired, the top reflux is provided by deethanizer overhead gas. Moreover, it is generally preferred that the demethanizer is refluxed with a second reflux stream (preferably at least two trays below the top reflux) that is provided by a portion of subcooled feed gas. Feed gas cooling is preferably achieved by use of one or more turboexpanders and/or one or more demethanizer side reboilers.

Using the above inventive configurations and methods, the volume ratio of methane to ethane content in the demethanizer bottom is controlled at about 2%, as necessary to meet the ethane product specification during ethane recovery. During ethane rejection, the methane to ethane volume ratio is increased to 10% such that more deethanizer overhead vapor is generated for refluxing the demethanizer, which thus eliminates the need for residue gas recycle.

Consequently, methods and configurations are now available to achieve ethane recovery of at least 95%, preferably at least 98%, and propane recovery of at least 95%, preferably at least 98%, more preferably at least 99%, and most preferably at least 99.9% during ethane recovery. Moreover, contemplated methods and configurations also achieve propane recovery of at least 99.9% during ethane rejection. Unless the context dictates the contrary, all ranges set forth herein should be interpreted as being inclusive of their endpoints, and open-ended ranges should be interpreted to include commercially practical values. Similarly, all lists of values should be considered as inclusive of intermediate values unless the context indicates the contrary.

It should still further be appreciated that the configurations and methods presented herein can process high pressure hydrocarbon feed gases (e.g. at least 1400 psig, and more preferably at least 1600 psig, and even higher). At such pressures, two stages of turbo-expansion are preferably included to so eliminate propane refrigeration typically required in conventional designs. In especially preferred configurations, the demethanizer side reboilers are also used for stripping the methane component in the feed gas by using the heat content of the feed gas, and turbo-expansion of the feed gas subsequently provides the cooling duty in the demethanizer FIG. 1 depicts an exemplary gas processing plant for ethane recovery and ethane rejection using a feed gas with a composition as shown in Table 1:

TABLE 1

| | Mole % |
|---|---|
| CO2 | 0.4 |
| Nitrogen | 0.4 |
| Methane | 88.9 |
| Ethane | 5.2 |
| Propane | 2.7 |
| i-Butane | 0.5 |
| n-Butane | 1.1 |
| n-Pentane | 0.3 |
| i-Pentane | 0.3 |
| n-Hexane | 0.1 |

More particularly, dried feed gas stream 1, at a temperature of about 95° F. and a pressure of about 1600 psig, is letdown in pressure to about 1100 psig via first turboexpander 51, forming stream 2 at about 55° F. The expander power is used to drive one of the residue gas compressors 52. The expanded gas is then split into two portions 3/4 and 5, with portion 3/4 being fed to the upper feed exchanger 56 and the other portion 5 being fed to the lower exchanger 64.

In the upper exchanger 56, the demethanizer overhead gas stream 26 at about −108° F. is used to chill and subcool the residue gas (or deethanizer overhead) stream 20 from about 110° F. to about −130° F. and a portion of the feed gas stream 3 from about 54° F. to about −130° F. The residue gas stream 14 from the demethanizer is warmed up to about 58° F. prior to compression in the residue gas compressor 52. During ethane recovery, these two subcooled streams (21 and 11) are used to form the first and second reflux streams (22 and 12 via JT valves 75 and 76, respectively) to the demethanizer 58. The first reflux 22 is fed to the top of the demethanizer and the second reflux 12 is fed to a position at the demethanizer that is at least two trays below the top tray. The residual refrigerant content in the demethanizer overhead gas is recovered by chilling a portion of the feed gas stream 4 from about 54° F. to about −20° F. forming stream 7. During ethane rejection, residue gas recycle flow is stopped by closing valve 80, and valve 79 is opened such that the top reflux is provided by deethanizer overhead vapor stream 32 via streams 49 and 20. The deethanizer overhead vapor is chilled from about 23° F. to about −108° F. forming an ethane rich reflux stream which is used during the ethane rejection operation.

In lower exchanger 64, the refrigerant content of the upper and lower side reboilers in the demethanizer are recovered via streams 23 and 24 by chilling the feed gas to about −21° F. forming stream 6. The chilled feed gas streams from the upper and lower exchangers are combined and separated in feed gas separator 57. The separator liquid stream 9 is letdown in pressure via JT valve 77 and fed as stream 10 to the lower section of the demethanizer 58, and separator vapor stream 8 is expanded in the second turboexpander 53 forming stream 19 at about −90° F., which is fed to the mid section of demethanizer 58.

During ethane recovery, the temperature of demethanizer bottom product 25 is heated to about 104° F. by the heat medium flow in reboiler 65 for controlling the methane component to the ethane component in the bottom liquid at a ratio of 2 volume %. A gas analysis is typically used to fine tune the reboiler temperature. During ethane rejection, the demethanizer bottom temperature stream 25 is lowered to about 64° F. in reboiler 65 such that the ratio of the methane component to the ethane component in the liquid is increased to about 10 volume %. The higher methane content is used in refluxing the demethanizer during the ethane rejection operation, which significantly reduces the power consumption of the residue gas compressor.

During ethane recovery, the demethanizer overhead vapor 26, at a pressure of about 472 psig, is heated from about −93° F. to about 110° F. by the residue gas recycle stream 20 and the feed gas streams 3 and 4, and then compressed by the first and second compressors 52 (via stream 15) and 54 to about 620 psig driven by turbo expanders 51 and 53. The gas stream 16 is further compressed to about 1185 psig by residual gas compressor 55. The compressor discharge 17 is cooled by air cooler 81 forming stream 18, and during ethane recovery, a portion 48 (about 20% of the total flow) of the residue gas stream 18 is recycled as stream 20 to the upper exchanger 56 as top demethanizer reflux 22. The remaining portion is sales gas stream 99.

During ethane recovery, the demethanizer 58 operates at a pressure of about 475 psig and the deethanizer 59 operates at a pressure of about 319 psig, and the demethanizer bottoms stream 25 is fed directly to the deethanizer by pressure differential without the use of bottoms pump 72 via stream 27. During ethane rejection, the demethanizer pressure is lowered to a pressure of about 445 psig and the deethanizer pressure is increased to a pressure of about 450 psig, thus requiring operation of bottoms pump 72. The deethanizer pressure is increased such that during ethane rejection, the deethanizer overhead stream 32 can be recycled back to the demethanizer as a top reflux (which replaces the residual gas recycle stream 48). The deethanizer overhead stream 29 is partially condensed using propane refrigeration in chiller 70 and the two phase stream 30 is separated in reflux drum 60. The separator liquid stream 31 is pumped by reflux pump 73 forming stream 33 for refluxing the deethanizer. The separator vapor stream 32 is the ethane product stream during ethane recovery. During ethane recovery, the deethanizer 59 (reboiled by reboiler 66) produces an overhead vapor stream 32 which can be exported as an ethane product and a bottoms liquid stream 28 which is further fractionated in depropanizer 61 into a propane product stream 41 and a butane plus product stream 35. Depropanizer 61 produces overhead stream 34 that is chilled in chiller 68 to produce stream 36 which is fed through drum 62 and separated from stream 37 into product stream 41 and depropanizer reflux via reflux pump 74. Reboiler 67 provides necessary heat for separation in column 61. During ethane rejection, the deethanizer overhead is recycled back to the demethanizer and the bottoms is fractionated in the depropanizer 61 into a propane product stream 41 and a butane plus product stream 35.

It should be appreciated that contemplated methods and configurations are also suitable where a relatively high-pressure supercritical feed gas (e.g., 1500 psig or higher) with relatively low propane and heavier content (about 3 mole %) is processed. Most preferably, the supercritical pressure feed gas is expanded to below its critical pressure (e.g., 1200 psig or lower) using a turboexpander, and the expanded vapor is split into three portions: The first portion is then chilled and subcooled, providing reflux to the demethanizer while the second portion is chilled, separated, and its vapor portion is fed to the stripping section of the demethanizer, and the third portion is used to recover the refrigerant content in the demethanizer side reboilers. Thus, suitable gas processing plants will include a first turboexpander that is configured to expand a feed gas to sub-critical pressure (e.g., between 1100 psig and 1200 psig), a first heat exchanger that subcools the feed gas to form a mid reflux to the demethanizer, and a second turboexpander that expands a vapor phase of the cooled feed gas to produce a feed stream to the demethanizer. It is especially preferred that first and second turbo-expanders are mechanically coupled to drive residue gas compressors. Most preferably, a second heat exchanger is thermally coupled to the demethanizer to at least recover the refrigeration content of the side reboilers in the demethanizer Moreover, it should also be recognized that contemplated configurations and methods are suitable to process rich gas streams (e.g., content of C3+ at least 10 mol % with at least 75 mol % of hydrocarbons being C2+). In such scenario all of the feed gas is expanded across the turbo expander and the operating pressure of the demethanizer is lowered to provide the front end chilling duty. An exemplary rich feed gas composition is provided in Table 2 below.

TABLE 2

| | Mole % |
|---|---|
| CO2 | 0.4 |
| Nitrogen | 1.1 |
| Methane | 0.0 |
| Ethane | 74.8 |
| Propane | 11.2 |
| i-Butane | 6.9 |
| n-Butane | 1.4 |
| n-Pentane | 2.7 |
| i-Pentane | 0.7 |
| n-Hexane | 0.7 |

To provide the front end cooling requirement, operating pressure of the demethanizer is lowered and the feed gas stream 3 for production of the second reflux stream 12 is stopped. Thus, the flow to the turboexpander 53 is increased. This reduction in demethanizer pressure, the increase in turboexpander cooling, and the use of residue gas recycle provides sufficient cooling duty for the rich gas process.

It is contemplated that at least a portion of the feed gas can be cooled to supply the reboiler duties of the demethanizer With respect to the heat exchanger configurations, it should be recognized that the use of side reboilers to supply feed gas and residue gas cooling and reflux duty will minimize total power requirement for ethane recovery and ethane rejection. Therefore, propane refrigeration can be minimized or even eliminated, which affords significant cost savings compared to known processes. Consequently, it should be noted that in the use of two turboexpanders coupled to the demethanizer and deethanizer operation allows stripping, and eliminating or minimizing propane refrigeration in the ethane recovery process, which in turn lowers power consumption and improves the ethane recovery. Further aspects and contemplations suitable for the present inventive subject matter are described in our International patent application WO 2005/045338 and U.S. Pat. No. 7,051,553, and U.S. Pat. App. No. 2010/0011809, all of which are incorporated by reference herein.

Thus, specific embodiments and applications of ethane recovery and ethane rejection configurations and methods therefor have been disclosed. It should be apparent, however, to those skilled in the art that many more modifications besides those already described are possible without departing from the inventive concepts herein. The inventive subject matter, therefore, is not to be restricted except in the spirit of the present disclosure. Moreover, in interpreting the specification and contemplated claims, all terms should be interpreted in the broadest possible manner consistent with the context. In particular, the terms "comprises" and "comprising" should be interpreted as referring to elements, components, or steps in a non-exclusive manner, indicating that the referenced elements, components, or steps may be present, or utilized, or combined with other elements, components, or steps that are not expressly referenced.

What is claimed is:

1. A method of flexibly recovering ethane from a feed gas, comprising:

expanding the feed gas in a turbo expander to produce a partially expanded feed gas;

cooling and additionally expanding a first portion of the partially expanded feed gas to produce a second reflux;

cooling a second portion of the partially expanded feed gas to produce a partially condensed feed stream;

separating the partially condensed feed stream into a vapor stream and a liquid stream;

expanding the vapor stream and the liquid stream prior to feeding into a demethanizer;

using a demethanizer side reboiler in cooling a third portion of the partially expanded feed gas to produce a cooled feed stream;

combining the cooled feed stream with the partially condensed feed stream;

feeding into the demethanizer a top reflux and the second reflux below the top reflux, wherein the demethanizer produces a demethanizer bottom product and a demethanizer overhead product;

feeding at least part of the demethanizer bottom product to a demethanizer to produce a demethanizer bottom product and a demethanizer overhead product; and feeding a portion of the demethanizer overhead product back to the demethanizer as the top reflux during ethane recovery, and feeding a portion of the demethanizer overhead product back to the demethanizer as the top reflux during ethane rejection;

wherein flow of the third portion of the partially expanded feed gas to the demethanizer side reboiler is decreased relative to flow of the first portion and the second portion of the partially expanded feed gas during ethane rejection.

2. The method of claim 1, wherein the demethanizer is operated at a higher pressure than the deethanizer during ethane recovery, and wherein the demethanizer is operated at a lower pressure than the demethanizer during ethane rejection.

3. The method of claim 1, wherein a propane recovery of at least 99% is achieved during ethane recovery and during ethane rejection.

4. The method of claim 1, wherein an ethane recovery of at least 95% is achieved during ethane recovery.

* * * * *